US008201648B2

(12) United States Patent
Choe et al.

(10) Patent No.: US 8,201,648 B2
(45) Date of Patent: Jun. 19, 2012

(54) EARTH-BORING PARTICLE-MATRIX ROTARY DRILL BIT AND METHOD OF MAKING THE SAME

(75) Inventors: Heeman Choe, Gunpo Si (KR); John Stevens, Spring, TX (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 180 days.

(21) Appl. No.: 12/361,653

(22) Filed: Jan. 29, 2009

(65) Prior Publication Data

US 2010/0187018 A1 Jul. 29, 2010

(51) Int. Cl.
*E21B 10/00* (2006.01)
*E21B 10/36* (2006.01)

(52) U.S. Cl. ..... 175/425; 175/327

(58) Field of Classification Search ..... 175/425, 175/327; 411/82.5; 403/28, 30
See application file for complete search history.

(56) References Cited

U.S. PATENT DOCUMENTS

| | | | | |
|---|---|---|---|---|
| 3,977,913 | A * | 8/1976 | Cabo et al. | 148/681 |
| 4,889,017 | A | 12/1989 | Fuller et al. | |
| 5,536,126 | A * | 7/1996 | Gross | 411/411 |
| 5,611,874 | A * | 3/1997 | Zadno-Azizi et al. | 148/402 |
| 6,073,518 | A | 6/2000 | Chow et al. | |
| 6,089,123 | A | 7/2000 | Chow et al. | |
| 6,220,117 | B1 | 4/2001 | Butcher | |
| 6,805,946 | B2 * | 10/2004 | Mulligan et al. | 428/292.4 |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0227775 | A1 | 10/2007 | Ma et al. | |
| 2008/0210473 | A1 | 9/2008 | Zhang et al. | |

FOREIGN PATENT DOCUMENTS

| | | |
|---|---|---|
| GB | 2385350 | 8/2003 |
| JP | 3461250 B2 | 8/2003 |
| JP | 2007281009 A | 10/2007 |

OTHER PUBLICATIONS

C.J.J. Eldering (Niels), "Technology Transfer: Challenges in Harsh Environments", ESA Technology Transfer & Promotion Office, European Space Agency (ESA) Noordwijk, The Netherlands Sep. 27, 2006.

(Continued)

*Primary Examiner* — Cathleen Hutchins
(74) *Attorney, Agent, or Firm* — Cantor Colburn LLP

(57) ABSTRACT

An earth-boring rotary drill bit includes a bit body configured to carry one or more cutters for engaging a subterranean earth formation, the bit body comprising a particle-matrix composite material having a plurality of hard particles dispersed throughout a matrix material, the matrix material comprising a shape memory alloy. The matrix material comprises a metal alloy configured to undergo a reversible phase transformation between an austenitic phase and a martensitic phase. The matrix material may include an Ni-based alloy, Cu-based alloy, Co-based alloy, Fe-based alloy or Ti-based alloy. The drill bit may be made by a method that includes: providing a plurality of hard particles in a mold to define a particle precursor of the bit body; infiltrating the particle precursor of the bit body with a molten matrix material comprising a shape memory alloy forming a particle-matrix mixture; and cooling the molten particle-matrix mixture to solidify the matrix material and forming a bit body having a particle-matrix composite material comprising a shape memory alloy.

13 Claims, 5 Drawing Sheets

OTHER PUBLICATIONS

International Search Report dated Sep. 1, 2010 for PCT/US2010/022531.

Written Opinion of the International Searching Authority dated Sep. 1, 2010 for PCT/US2010/022531.

* cited by examiner

EARTH-BORING PARTICLE-MATRIX ROTARY DRILL BIT AND METHOD OF MAKING THE SAME

BACKGROUND

Rotary drill bits are commonly used for drilling boreholes or wells in earth formations. Earth-boring rotary drill bits include two general configurations. One configuration is the roller cone bit, which typically includes three roller cones mounted on support legs that extend from a bit body. The roller cones are each configured to spin or rotate on a support leg. The outer surfaces of each roller cone generally include cutting teeth for cutting rock and other earth formations. These cutting teeth are frequently coated with a hardfacing material, such as a superabrasive material. Such materials often include tungsten carbide particles dispersed throughout a metal alloy matrix material. Alternately, receptacles are provided on the outer surface of each roller cone into which superabrasive inserts are secured to form the cutting elements. The roller cone drill bit may be placed in a borehole such that the roller cones are adjacent the earth formation to be drilled. As the drill bit is rotated, the roller cones roll across the surface of the formation and the cutting teeth crush the underlying earth formation.

A second configuration of a rotary drill bit is the fixed-cutter bit, often referred to as a "drag" bit. These bits generally include an array of cutting elements secured to a face region of the bit body. The cutting elements of a fixed-cutter type drill bit generally have either a disk shape or a substantially cylindrical shape. A hard, superabrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. Typically, the cutting elements are fabricated separately from the bit body and secured within pockets formed in the outer surface of the bit body. A bonding material, such as an adhesive or a braze alloy, may be used to secure the cutting elements to the bit body. A fixed-cutter drill bit is placed in a borehole such that the cutting elements are in contact with the earth formation to be drilled. As the drill bit is rotated, the cutting elements scrape across and shear away the surface of the underlying formation.

The bit body of a rotary drill bit typically is secured to a hardened steel shank having an American Petroleum Institute (API) threaded pin for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the borehole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such materials include hard particles randomly dispersed throughout a matrix material (often referred to as a "binder" material.) Particle-matrix composite material bit bodies may be formed by embedding a metal blank in a carbide particulate material volume, such as particles of tungsten carbide, and then infiltrating the particulate carbide material with a matrix material, such as a copper alloy. Drill bits that have a bit body formed from such a particle-matrix composite material may exhibit increased erosion and wear resistance compared to similar bits made from steel, but generally have lower strength and toughness relative to drill bits having steel bit bodies.

While bit bodies that include particle-matrix composite materials offer significant advantages over all-steel bit bodies in terms of abrasion and erosion-resistance, the lower strength and toughness of such bit bodies limit their use in certain applications. In particular, particle-matrix composite materials are known to exhibit brittle facture when subjected to high strain-rate impact loading, such as loading at strain rates greater than $10^2$ $sec^{-1}$. In a drilling environment, such loading can occur during drilling without warning. It is known to result in fracture of blades or cutters and resultant failure of the drill bit. Such failures are costly, as they generally require cessation of drilling while the drill string, drill bit or both are removed from the borehole for repair or replacement of the drill bit.

Therefore, improvement of the particle-matrix composite to increase the toughness, strength or other properties to reduce the occurrence of brittle fracture during drilling would be desirable and would increase the applications where such bit bodies may be used.

SUMMARY

In one aspect, an earth-boring rotary drill bit includes a bit body configured to carry one or more cutters for engaging a subterranean earth formation. The bit body includes a particle-matrix composite material having a plurality of hard particles dispersed throughout a matrix material, where the matrix material includes a shape memory alloy. The shape memory alloy includes a metal alloy configured to undergo a reversible phase transformation between an austenitic phase and a martensitic phase. The matrix material may include an Ni-based alloy, Cu-based alloy, Co-based alloy, Fe-based alloy or Ti-based alloy.

In another aspect, the drill bit may be made by a method that includes: providing a plurality of hard particles in a mold to define a particle precursor of the bit body; infiltrating the particle precursor of the bit body with a molten matrix material comprising a shape memory alloy forming a particle-matrix mixture; and cooling the molten particle-matrix mixture to solidify the matrix material and form a bit body comprising a particle-matrix composite material having a shape memory alloy matrix.

BRIEF DESCRIPTION OF THE DRAWINGS

The following is a brief description of the drawings.

DETAILED DESCRIPTION

The illustrations presented herein, are not meant to be actual views of any particular material, apparatus, system, or method, but are merely idealized representations of that which is disclosed herein. Additionally, elements common between figures may retain the same numerical designation.

As used herein, the term "[metal]-based alloy" (where [metal] is any metal) means commercially pure [metal] in addition to [metal] alloys wherein the weight percentage of [metal] in the alloy is greater than the weight percentage of any other component of the alloy. Where two or more metals are listed in this manner, the weight percentage of the listed metals in combination is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon in any stoichiometric or non-stoichiometric ratio or proportion, such as, for example, WC, $W_2C$, and combinations of WC and $W_2C$. Tungsten carbide includes any morphological form of this material, for example, cast tungsten carbide, sintered tungsten carbide, and macrocrystalline tungsten carbide.

Figure 1:
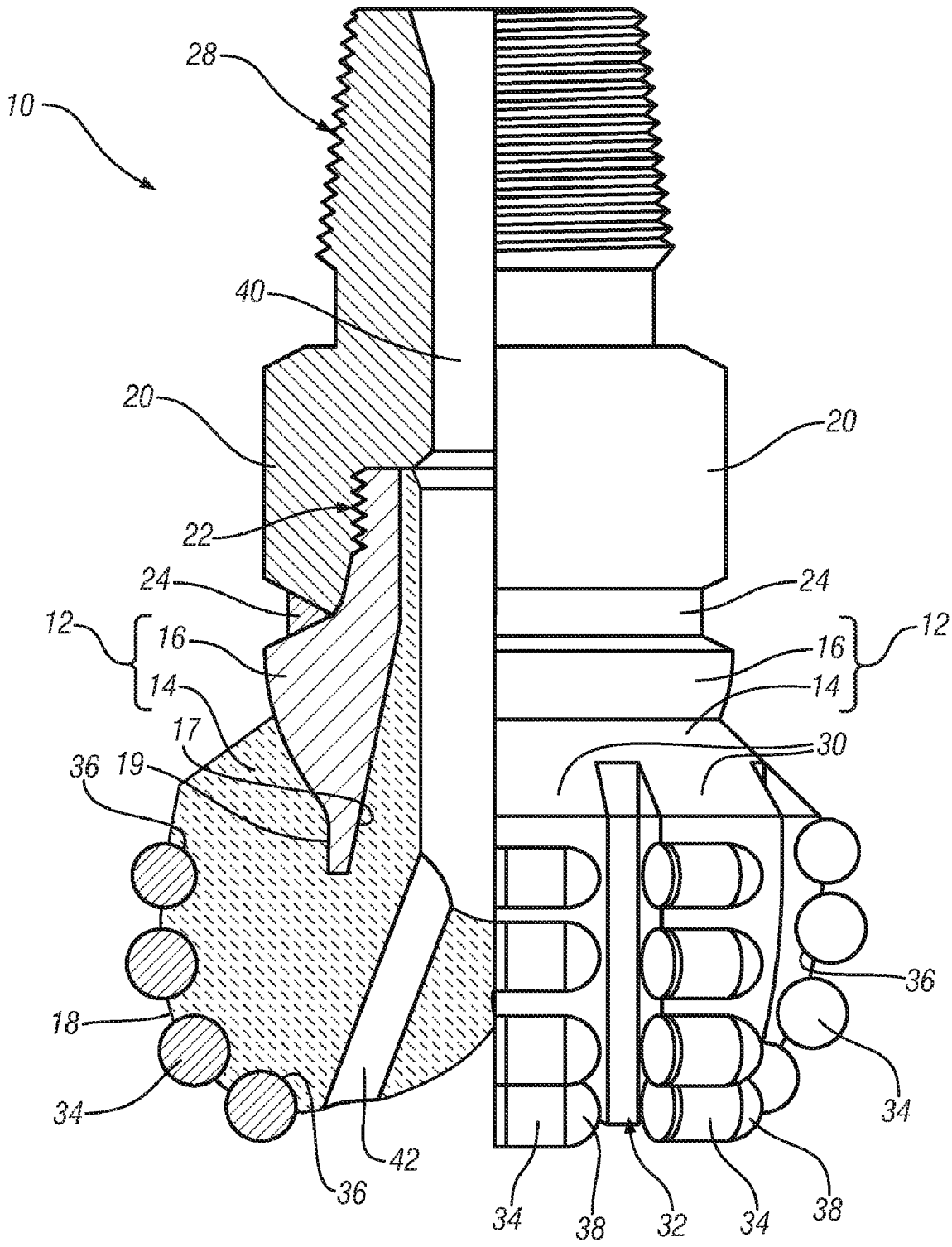
FIG. 1 is a schematic partial cross-sectional view of an exemplary embodiment of an earth-boring rotary drill bit as disclosed herein.

An exemplary embodiment of an earth-boring rotary drill bit 10 having a bit body that includes a particle-matrix composite material, where the matrix includes a shape memory alloy, is illustrated in FIG. 1. The bit body 12 is secured to a shank 20, such as a steel shank. The bit body 12 includes a crown and a metal blank 16 that is partially embedded in the crown 14. The crown 14 includes a particle-matrix composite material such as, for example, particles of tungsten carbide embedded in a shape memory alloy matrix material.

Many shape memory alloy material compositions are possible for crown 14 and any suitable combination of particles and shape memory alloy matrix materials may be used. The particle-matrix composite material of the crown 14 may include a plurality of hard particles dispersed randomly throughout a shape memory alloy matrix material. The hard particles may comprise diamond or ceramic materials such as carbides, nitrides, oxides, and borides (including boron carbide ($B_4C$)) and combinations of them, such as carbonitrides. More specifically, the hard particles may comprise carbides and borides made from elements such as W, Ti, Mo, Nb, V, Hf, Ta, Cr, Zr, Al, or Si. By way of example and not limitation, materials that may be used to form hard particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminium oxide ($Al_2O_3$), aluminium nitride (AlN), boron nitride (BN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

Figure 2A:
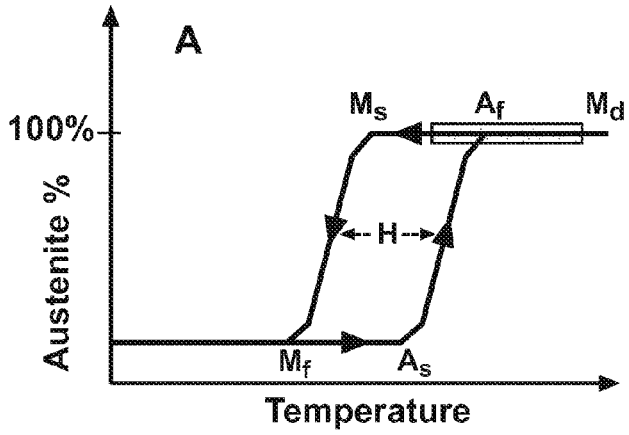
FIG. 2A is a schematic illustration of an exemplary embodiment of the reversible austenite-martensite transformation associated with the shape memory effect.
Figure 2B:
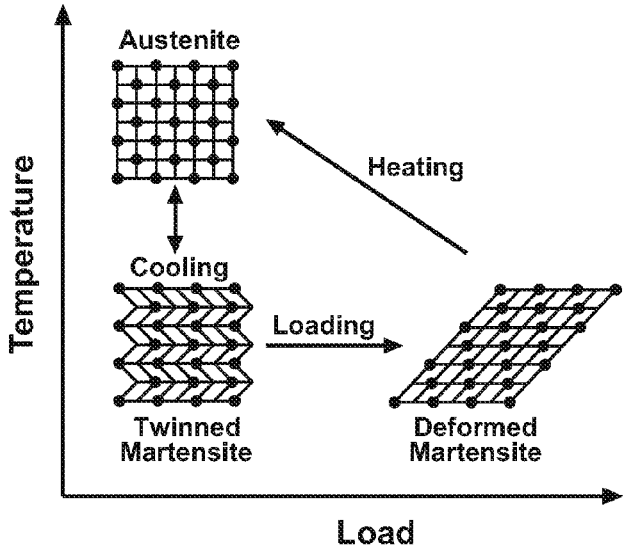
FIG. 2B is a schematic illustration of the austenite-martensite transformation associated with a shape memory effect alloy illustrating the microstructural configurations of the alloy at various temperatures and loads.
Figure 2C:
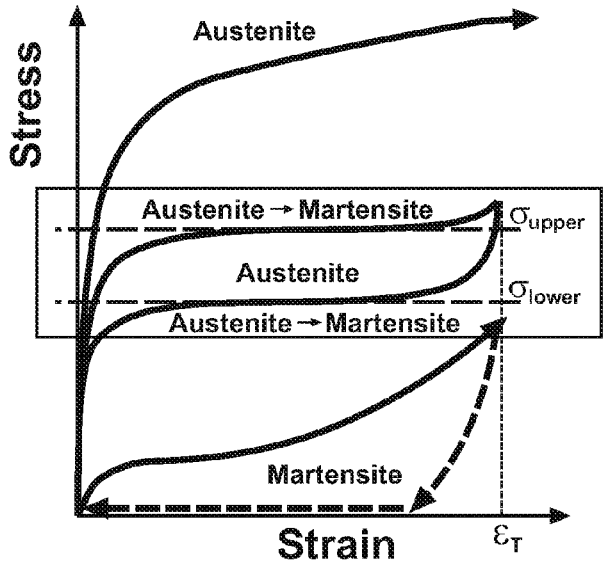
FIG. 2C is a schematic illustration of the stress-strain response of a shape memory alloy.

The shape memory alloy matrix material of the particle-matrix composite material may include any suitable shape memory material, including shape memory alloys, having the physical properties, including, without limitation, yield strength, tensile strength, fracture toughness and fatigue resistance suitable for use as a bit body for an earth boring drill bit. Shape memory materials, and particularly, shape memory alloys exhibit pseudoelasticity and a shape memory effect. Pseudoelasticity is sometimes called superelasticity, and is an impermanent and reversible elastic response exhibited by shape memory alloys associated with a phase transformation between an austenitic and martensitic phase of the matrix material that is triggered by a temperature change (FIGS. 2A and 2B) or applied stress (FIG. 2C). Upon occurrence of the phase transformation, the elastic response can also be associated with a twinning deformation. Twinning deformation, which is very similar to a martensitic transformation in that it is also a diffusionless transformation, is an alternative process leading to deformation of the shape memory alloy material through a distortion of the crystal lattice. In particular, when a stress is applied above the martensitic transformation limit ($M_S$) of a shape memory alloy, a stress induced transformation can take place, followed by twinning deformation. This unique property of a shape memory alloy can be very powerful in impact loading conditions, such as those that occur during drilling and may be placed on the drill bit during drilling due to a sudden transition in the earth strata being drilled, or due to sudden movement of the drill string, or a combination of the above, or due to other factors. Impact loading results in impact stresses that produce instantaneous strain rates of greater than $10^2$ $sec^{-1}$. This level of instantaneous strain cannot be accommodated in conventional matrix materials, hence these materials frequently exhibit brittle fracture behavior in use. However, shape memory materials can eliminate or reduce the tendency to brittle fracture because the martensitic transformation and twinning deformation take place much more rapidly than dislocation glide associated with normal elastic deformation (e.g., microsecond response versus millisecond response), thus they are much more able to accommodate high strain rate loading. These materials can reversibly accommodate total elastic strain ($\epsilon_T$) up to about 8%, as shown in FIG. 2C. Pseudoelasticity results from the reversible motion of domain boundaries during the phase transformation, rather than just bond stretching or the introduction of defects into the crystal lattice (thus it is not true superelasticity but rather pseudoelasticity). Upon unloading, a reverse transformation takes place at a relatively constant stress and the drill bit will return to its original shape. As a result, the overall stress-strain curve of an shape memory alloy drill bit resembles that of an elastomer, as shown in FIG. 2C. Even if the domain boundaries do become pinned, they may be reversed through heating, as illustrated in FIG. 2B. Therefore, a pseudoelastic material may return to its previous shape (hence, shape memory effect) after the removal of even relatively high applied stresses and resultant strains. Thus, materials exhibiting this characteristic behavior are sometimes referred to as "smart" materials.

Suitable shape memory materials include, without limitation Ni-based, Ti-based, Ni—Ti based, Co-based, Fe-based and Cu-based shape memory alloys. As an example, Cu-based alloys may include various Cu—Zn—Al alloys or a Cu—Al—Ni alloys. More particularly, they may include Cu—Zn—X alloys where X is Al, Si or Sn. Further, they may include Cu—Zn—X alloys, where X is Si or Sn, having, in weight percent: 38-41.5% Zn, 0-<5% X and the balance substantially Cu. Further, they may include Cu—Zn—X alloys, where X is Al, having in weight percent: 15-40% Zn, 3-10% Al and the balance substantially Cu. Further, they may include Cu—Al—Ni alloys having, in weight percent: 12-14.5% Al, 3-4.5% Ni and the balance substantially Cu. As a further example, Ni-based or Ti-based alloys may include various Ni—Ti alloys. More particularly, it may include Ni—Ti alloys having, in atom percent: 49-51% Ni and the balance substantially Ti. As a further example, Fe-based alloys may include Fe—Mn—Si alloys, and Co—based alloys may include Co—Ni—Al alloys and Co—Ni—Ga alloys. As used herein, the phrase "the balance substantially" with reference to a constituent means it comprises most of the balance of the alloy; however, use of this term does not preclude relatively small amounts of other alloy constituents (e.g., amounts which are less than stated amounts of other constituents) or impurities that are incidental to the manufacture of the alloy or any of its constituents.

The bit body 12 is secured to the steel shank 20 by way of a threaded connection 22 and a weld 24 extending around the drill bit 10 on an exterior surface thereof along an interface between the bit body 12 and the steel shank 20. The steel shank 20 includes an API threaded connection portion 28 for attaching the drill bit 10 to a drill string (not shown).

The bit body 12 includes wings or blades 30, which are separated by external channels or conduits also known as junk slots 32. Internal fluid passageways 42 extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways 42.

A plurality of PDC cutters 34 may be provided on the face 18 of the bit body 12. The PDC cutters 34 may be provided along the blades 30 within pockets 36 formed in the face 18 of the bit body 12, and may be supported from behind by buttresses 38, which may be integrally formed with the crown 14 of the bit body 12.

The metal blank 16 shown in FIG. 1 is generally cylindrically tubular. Alternatively, the metal blank 16 may have a fairly complex configuration and may include external protrusions corresponding to blades 30 or other features on and extending on the face 18 of the bit body 12 (not shown), or a plurality of annularly or radially spaced slots or other features that extend through the annular wall of blank 16 which facilitate continuity of the particle-matrix composite material between an inner surface 17 and outer surface 19 of metal blank 16. By way of example and not limitation, metal blank 16 may comprise a ferrous alloy, such as steel. Further, by way of example and not limitation, metal blank 16 may comprise a shape memory material, including the shape memory alloys, as described herein.

During drilling operations, the drill bit 10 is positioned at the bottom of a wellbore and rotated while drilling fluid is pumped to the face 18 of the bit body 12 through the longitudinal bore 40 and the internal fluid passageways 42. As the PDC cutters 34 shear or scrape away the underlying earth formation, the formation cuttings mix with and are suspended within the drilling fluid and pass through the junk slots 32 and the annular space between the wellbore and the drill string to the surface of the earth formation.

Figure 3A:
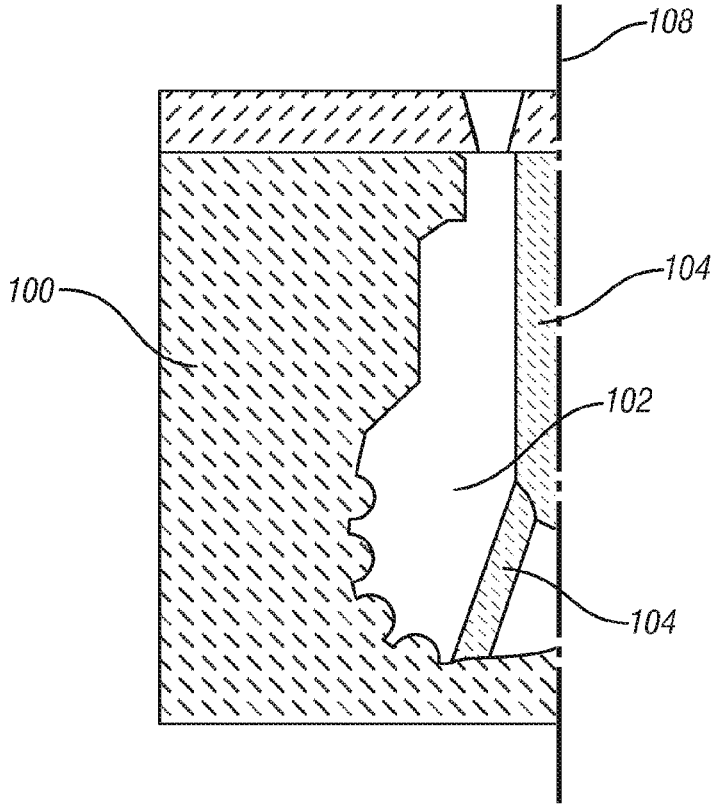
FIGS. 3A-C are schematic partial cross-sectional views illustrating various stages of a method of making an earth-boring rotary drill bit disclosed herein.
Figure 3B:
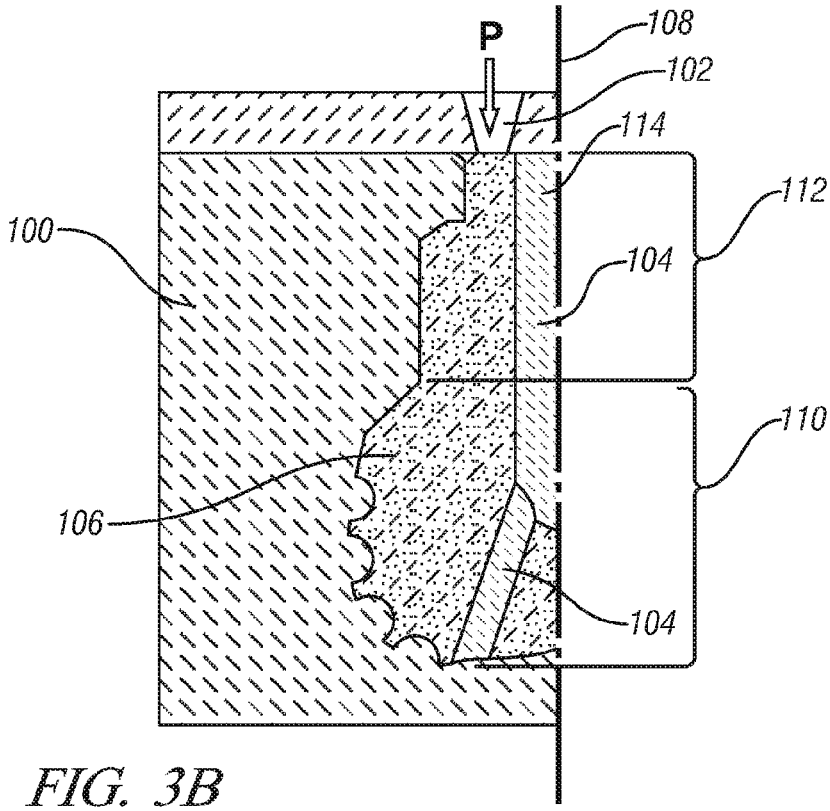
Figure 3C:
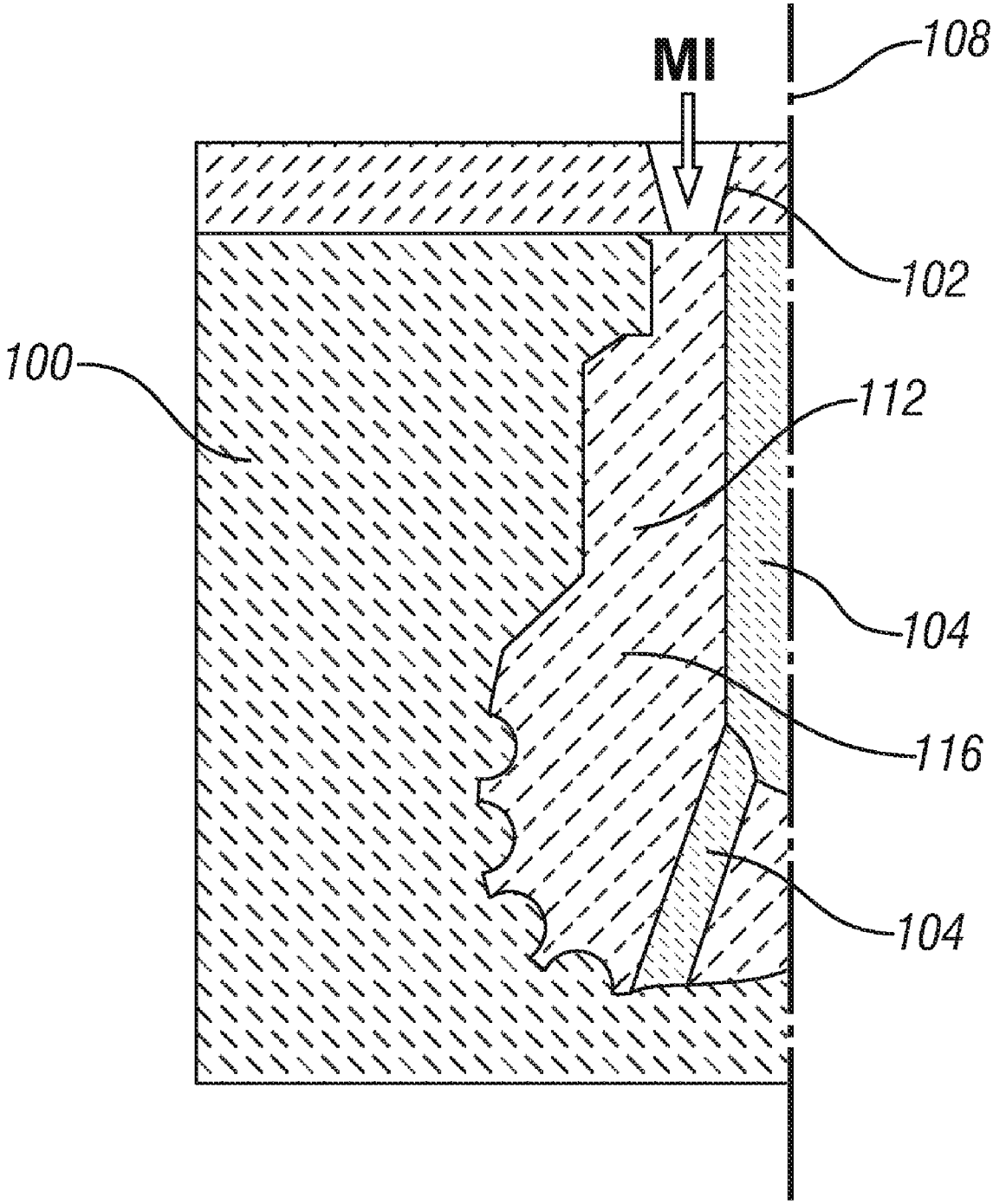
Figure 4:
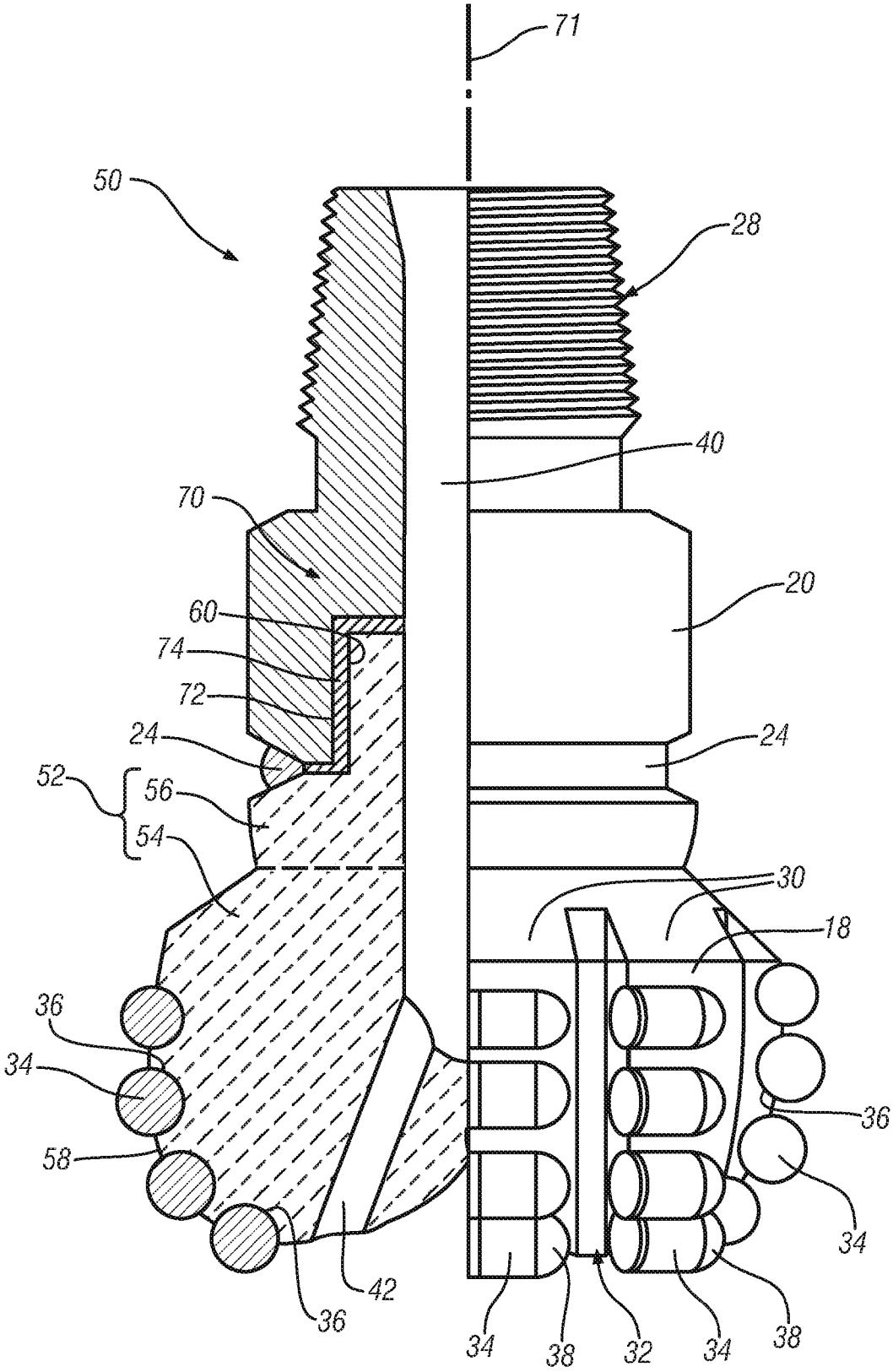
FIG. 4 is a schematic partial cross-sectional view of a second exemplary embodiment of an earth-boring rotary drill bit as disclosed herein.

A method of making earth boring rotary drill bits having multi-layer particle-matrix composite bit bodies of the type described herein is described in FIGS. 3A-3C. Referring to FIG. 3A, bit bodies that include a multi-layer particle-matrix composite material, such as those described herein may be fabricated in graphite molds 100. The cavities 102 of the graphite molds may be conventionally machined with a five-axis machine tool. Fine features may then be added to the cavity of the graphite mold by hand-held tools. Additional clay work may also be required to obtain the desired configuration of some features of the bit body. Where necessary, preform elements or displacements 104 (which may include ceramic components, graphite components, resin-coated sand compact components and the like) may be positioned within the mold and used to define the internal passageways 42, cutting element pockets 36, junk slots 32, and other external topographic features of the bit body (FIGS. 1 and 4).

The cavity 102 (FIG. 3A) of the graphite mold is filled, as shown by arrow P, with hard particulate material 106 of the types described herein, as shown in FIG. 3B. This may include particulate material with a single range of sizes, or a single material with a plurality of size ranges along the depth of cavity 102 (i.e., along its longitudinal axis 108). The hard particles may also comprise a plurality of different hard particle materials. For example, the hard particles may have a first hard particle composition, size distribution or both in the first region of the mold 110 and a different hard particle composition, size distribution or both in the second region 112. Further, the hard particles may include more than two hard particle compositions, size distributions, or both, in any number. Once loaded into the mold cavity 102, hard particles 106 may be compacted or otherwise densified, such as by vibrating the mold, to decrease the amount of space between adjacent particles of the particulate material and form particle precursor 114 that will be infiltrated by the respective matrix materials in the manner described herein. Optionally, an insert (not shown), such as preformed metal blank ( see e.g. metal blank 16 of FIG. 1) may then be positioned in an upper portion of the mold at the appropriate location and orientation. When employed, an insert, such as a metal blank, typically is at least partially embedded in the particulate material within the mold.

A shape memory alloy matrix material, such as, for example, a copper-based shape memory alloy, is melted and poured into the mold cavity as illustrated by arrow M1. The particulate precursor 114 is infiltrated with the molten matrix material M1 to form a molten particle-matrix material mixture 116. The mold and bit body may be cooled to solidify the matrix material and form the particle-matrix composite 110.

Referring to FIGS. 3B and 3C, upon filling the mold cavity and infiltrating particulate precursor 114, the molten particle-matrix material mixture 116, including any optional insert, such as a metal blank, is cooled to solidify the matrix materials and form a particle matrix composite having a matrix of a shape memory alloy. The embodiment used to illustrate the method is most similar to the drill bit illustrated in FIG. 4, but is equally applicable with inclusion of the optional insert, to the bit configuration illustrated in FIG. 1, as well as any number of other bit and bit body configurations (not shown).

Referring again to FIG. 1, the mold may also optionally include an insert, such as a metal blank. Upon solidification, the metal blank is metallurgically bonded to the particle-matrix composite material, particularly the shape memory alloy matrix, forming the crown 14 of the bit body 12.

Once the bit body has cooled, the bit body is removed from the mold and any displacements are removed from the bit body. Destruction of the graphite mold may be required to remove the bit body.

After the bit body has been removed from the mold and any secondary operations desired to form the bit body, or optional metal blank, have been employed, such as machining or grinding, the bit body may be secured to a steel shank. As the particle-matrix composite material used to form the crown 14 is relatively hard and not easily machined, a metal blank (not shown) may be used to secure the bit body to the shank. Threads may be machined on an exposed surface of the metal blank to provide a threaded connection between the bit body and the steel shank, as shown in FIG. 1. The steel shank may be threaded onto the bit body, and a weld then may be provided along the interface between the bit body and the steel shank.

The PDC cutters may be bonded to the face of the bit body after the bit body has been cast by, for example, brazing, mechanical, or adhesive affixation. Alternatively, the cutters may be bonded to the face of the bit body during forming of the bit body if thermally stable synthetic or natural diamonds are employed in the cutters.

An earth-boring rotary drill bit 50 of a second exemplary embodiment is shown in FIG. 4. The rotary drill bit 50 has a bit body 52 that includes a particle-matrix composite material. The rotary drill bit 50 may also include a shank 70 attached to the bit body 52.

The shank 70 includes a generally cylindrical wall 72 having an outer surface and an inner surface. The wall 72 of the shank 70 encloses at least a portion of a longitudinal bore 40 that extends through the rotary drill bit 50. At least one surface of the wall 72 of the shank 70 may be configured for attachment of the shank 70 to the bit body 52. The shank 70 also may include a male or female API threaded connection portion 28 for attaching the rotary drill bit 50 to a drill string (not shown).

The bit body 52 of the rotary drill bit 50 is formed from and composed of a particle-matrix composite material as described herein. Furthermore, the composition of the particle-matrix composite material may be selectively varied within the bit body 52 to provide various regions within the bit body that have different, custom tailored physical properties or characteristics.

By way of example and not limitation, the bit body 52 may include first region 54 having a first material composition and a body portion or second region 56 having a second material composition that is different from the first material composition, such as by having particles with a first size distribution in the first region and a second particle size distribution in the second region. The first region 54 may include the longitudinally-lower and laterally-outward regions of the bit body 52. The first region 54 may include the face 58 of the bit body 52, which may be configured to carry a plurality of cutting elements, such as PDC cutters 34. For example, a plurality of pockets 36 and buttresses 38 may be provided in or on the face 58 of the bit body 52 for carrying and supporting the PDC cutters 34. Furthermore, a plurality of blades 30 and junk slots 32 may be provided in the first region 54 of the bit body 52. The body portion or second region 56 may include the longitudinally-upper and laterally-inward regions of the bit body 52. The longitudinal bore 40 may extend at least partially through the second region 56 of the bit body 52.

The second region 56 may include at least one surface 60 that is configured for attachment of the bit body 52 to the shank 70 such as by forming a protrusion 58. By way of example and not limitation, at least one surface 60 of the second region 56 is configured for attachment of the bit body 52 to a mating surface 72 of the shank 70. Either mechanical interference (not shown), a weld joint 24 or braze joint 74, or a combination of them between the shank 70, and the bit body 52 may prevent longitudinal separation of the bit body 52 from the shank 70, and may prevent rotation of the bit body 52 about a longitudinal axis 71 of the rotary drill bit 50 relative to the shank 70.

A brazing material such as, for example, a silver-based or nickel-based metal alloy may be provided as braze joint 74 in a substantially uniform gap between the shank 70 and the surface 60 in the second region 56 of the bit body 52. As an alternative to brazing, or in addition to brazing, a weld 24 may be provided around the rotary drill bit 50 on an exterior surface thereof along an interface between the bit body 52 and the steel shank 70. The weld 24 and the braze joint 74 may be used to further secure the shank 70 to the bit body 52.

The composition of bit body 52 may be homogeneous. Alternately, as previously stated, the first region 54 of the bit body 52 may have a first material composition and the second region 56 of the bit body 52 may have a second material composition that is different from the first material composition. The first region 54 may include a particle-matrix composite material. The second region 56 of the bit body 52 may include a metal, a metal alloy, or a particle-matrix composite material, or a combination of them. By way of example and not limitation, the second region may include the same shape memory alloy matrix as the first region 54, but a varying distribution of particles, such that the volume fraction of particles is substantially the same at the interface and is reduced at locations away from the interface. Further, by way of example and not limitation, the material composition of the first region 54 may be selected to exhibit higher erosion and wear-resistance than the material composition of the second region 56. The material composition of the second region 56 may be selected to facilitate machining of the second region 56. The manner in which the physical properties may be tailored to facilitate machining of the second region 56 may be at least partially dependent of the method of machining that is to be used. For example, if it is desired to machine the second region 56 using conventional turning, milling, and drilling techniques, the material composition of the second region 56 may be selected to exhibit lower hardness and higher ductility. Alternately, if it is desired to machine the second region 56 using ultrasonic machining techniques, which may include the use of ultrasonically-induced vibrations delivered to a tool, the composition of the second region 56 maybe selected to exhibit a higher hardness and a lower ductility. In some embodiments, the material composition of the second region 56 may be selected to exhibit higher fracture toughness than the material composition of the first region 54. In yet other embodiments, the material composition of the second region 56 may be selected to exhibit physical properties that are tailored to facilitate welding or brazing of the second region 56. By way of example and not limitation, the material composition of the second region 56 may be selected to facilitate welding of the second region 56 to the shank 70. It is understood that the various regions of the bit body 52 may have material compositions that are selected or tailored to exhibit any desired particular physical property or characteristic, and the present invention is not limited to selecting or tailoring the material compositions of the regions to exhibit the particular physical properties or characteristics described herein.

Certain physical properties and characteristics of a composite material (such as hardness) may be defined using an appropriate rule of mixtures, as is known in the art. Other physical properties and characteristics of a composite material may be determined without resort to the rule of mixtures. Such physical properties may include, for example, erosion and wear resistance.

The particle-matrix composite material of the first region 54 may include a plurality of hard particles dispersed randomly throughout a shape memory alloy matrix material, as described herein.

The second region 56 of the bit body 52 may be substantially formed from and composed of the same material used as the matrix material in the particle-matrix composite material of the first region 54.

In another embodiment, both the first region 54 and the second region 56 of the bit body 52 may be substantially formed from and composed of a particle-matrix composite material.

The methods of forming earth-boring rotary drill bits described herein may allow the formation of novel drill bits having bit bodies that include particle-matrix composite materials that exhibit superior erosion and wear-resistance, strength, and impact resistance or fracture toughness relative to known particle-matrix composite drill bits. The methods allow for attachment of the shank to the bit body with proper alignment and concentricity provided therebetween. The methods described herein allow for improved attachment of a shank to a bit body having at least a crown region that includes a particle-matrix composite material by precision machining at least a surface of the bit body, the surface being configured for attachment of the bit body to the shank.

With continued reference to FIG. 4, the shank 70 includes a male or female API threaded connection portion for connecting the rotary drill bit 50 to a drill string (not shown). The shank 70 may be formed from and composed of a material that is relatively tough and ductile relative to the bit body 52. By way of example and not limitation, the shank 70 may include a steel alloy. Further, by way of example and not limitation, the shank 70 may comprise a shape memory material, including the shape memory alloys, as described herein.

Furthermore, interfering non-planar surface features (not shown) may be formed on the surface 60 of the bit body 52 and the surface 72 of the shank 70. For example, threads or longitudinally-extending splines, rods, or keys (not shown) may be provided in or on the surface 60 of the bit body 52 and the surface 72 of the shank 70 to prevent rotation of the bit body 52 relative to the shank 70.

During all infiltration or casting processes, refractory structures or displacements 104 may be used to support at least portions of the bit body and maintain desired shapes and dimensions during the solidification process. Such displacements may be used, for example, to maintain consistency in the size and geometry of the cutter pockets 36 and the internal fluid passageways 42 during the sintering process. Such refractory structures may be formed from, for example, graphite, silica, or alumina. The use of alumina displacements instead of graphite displacements may be desirable as alumina may be relatively less reactive than graphite, thereby minimizing atomic diffusion during solidification. Additionally, coatings such as alumina, boron nitride, aluminum nitride, or other commercially available materials may be applied to the refractory structures to prevent carbon or other atoms in the refractory structures from diffusing into the bit body during solidification.

A shrink fit may also be provided between the shank 70 and the bit body 52 in alternative embodiments. By way of example and not limitation, the shank 70 may be heated to cause thermal expansion of the shank while the bit body 52 is cooled to cause thermal contraction of the bit body 52. The shank 70 then may be pressed onto the bit body 52 and the temperatures of the shank 70 and the bit body 52 may be allowed to equilibrate. As the temperatures of the shank 70 and the bit body 52 equilibrate, the surface 72 of the shank 70 may engage or abut against the surface 60 of the bit body 52, thereby at least partly securing the bit body 52 to the shank 70 and preventing separation of the bit body 52 from the shank 70.

In another alternative embodiment, a friction weld may be provided between the bit body 52 and the shank 70. Mating surfaces 72,60 may be provided on the shank 70 and the bit body 52, respectively. A machine may be used to press the shank 70 against the bit body 52 while rotating the bit body 52 relative to the shank 70. Heat generated by friction between the shank 70 and the bit body 52 may at least partially melt the material at the mating surfaces of the shank 70 and the bit body 52. The relative rotation may be stopped and the bit body 52 and the shank 70 may be allowed to cool while maintaining axial compression between the bit body 52 and the shank 70, providing a friction welded interface between the mating surfaces of the shank 70 and the bit body 52.

In yet another alternate embodiment, commercially available adhesives such as, for example, epoxy materials (including inter-penetrating network (IPN) epoxies), polyester materials, cyanoacrylate materials, polyurethane materials, and polyimide materials may also be used to secure the shank 70 to the bit body 52.

A circumferential weld 24 may also be provided between the bit body 52 and the shank 70, separately or in combination with the welding, brazing and pin attachments described herein, that extends around the rotary drill bit 50 on an exterior surface thereof along an interface between the bit body 52 and the shank 70. A tungsten insert gas weld (TIG) process, a shielded metal arc welding (SMAW) process, a gas metal arc welding (GMAW) process, a flux core arc welding (FCAW) process, a gas tungsten arc weld (GTAW) process, a plasma transferred arc (PTA) welding process, a submerged arc welding (SAW) process, an electron beam welding (EBW) process, or a laser beam welding (LBW) process may be used to weld the interface between the bit body 52 and the shank 70. Furthermore, the interface between the bit body 52 and the shank 70 may be soldered or brazed using processes known in the art to further secure the bit body 52 to the shank 70.

While the description herein presents certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit body profiles as well as cutter types.

The foregoing invention has been described in accordance with the relevant legal standards, thus the description is exemplary rather than limiting in nature. Variations and modifications to the disclosed embodiments may become apparent to those skilled in the art. Accordingly, the scope of legal protection afforded will be determined in accordance with the following claims.

We claim:

1. An earth-boring rotary drill bit comprising:

a bit body configured to carry one or more cutters for engaging a subterranean earth formation, the bit body comprising a particle-matrix composite material having a plurality of hard particles randomly dispersed throughout a matrix material, the matrix material comprising a shape memory alloy, wherein the dispersed particles of the particle-matrix composite material are randomly dispersed within the matrix material by infiltration and solidification of molten matrix material within a particle precursor of the hard particles.

2. The rotary drill bit of claim 1, wherein the matrix material comprises a metal alloy configured to undergo a reversible phase transformation between an austenitic phase and a martensitic phase.

3. The rotary drill bit of claim 1, wherein the matrix material comprises an Ni-based alloy, Cu-based alloy, Fe-based alloy, Co-based alloy or Ti-based alloy.

4. The rotary drill bit of claim 3, wherein the matrix material is a Cu—Zn—X alloy or a Cu—Al—Ni alloy, where X is Al, Si or Sn, or a combination thereof.

5. The rotary drill bit of claim 4, wherein the matrix material is a Cu—Zn—X alloy, where X is Si or Sn, comprising, in weight percent: 38-41.5% Zn, $0<X<5\%$ X and the balance substantially Cu.

6. The rotary drill bit of claim 4, wherein the matrix material is a Cu—Zn—X alloy, where X is Al, comprising, in weight percent: 15-40% Zn, 3-10% Al and the balance substantially Cu.

7. The rotary drill bit of claim 4, wherein the matrix material is a Cu—Al—Ni alloy comprising, in weight percent: about 14-14.5% Al, 3-4.5% Ni and the balance substantially Cu.

8. The rotary drill bit of claim 3, wherein the matrix material is an Ni—Ti alloy, an Fe—Mn—Si alloy, a Co—Ni—Al alloy or a Co—Ni—Ga alloy.

9. The rotary drill bit of claim 8, wherein the matrix material is an Ni—Ti alloy comprising, in atom percent: 49-51% Ni and the balance substantially Ti.

10. The rotary drill bit of claim 1, wherein the hard particles comprise diamond, or metal or semi-metal carbides, nitrides, oxides, or borides.

11. The rotary drill bit of claim 1, further comprising a metal blank having a bit body portion that is metallurgically bonded to the bit body and a shank portion configured for attachment to a shank.

12. The rotary drill bit of claim 1, further comprising a shank extending from the metal blank, the shank comprising a bit body portion attaching the shank to the bit body and an attachment portion configured to attach the shank to a drill string.

13. An earth-boring rotary drill bit comprising:

a bit body configured to carry one or more cutters for engaging a subterranean earth formation, the bit body comprising a particle-matrix composite material having a plurality of hard particles non-homogeneously dispersed throughout a matrix material, the matrix material comprising a shape memory alloy, wherein the particle-matrix composite material is configured to provide reversible twinning deformation in response to an impact condition, and wherein the dispersed particles of the particle-matrix composite material are non-homogeneously dispersed within the matrix material by infiltration and solidification of molten matrix material within a particle precursor of the hard particles.

* * * * *